US005388810A

United States Patent [19]

Boring

[11] Patent Number: 5,388,810

[45] Date of Patent: Feb. 14, 1995

[54] CERMET CRUCIBLE FOR METALLURGICAL PROCESSING

[75] Inventor: Christopher P. Boring, Andersonville, Tenn.

[73] Assignee: The United States of America as represented by the United States Department of Energy, Washington, D.C.

[21] Appl. No.: 186,369

[22] Filed: Jan. 25, 1994

[51] Int. Cl.[6] ..... C21B 3/00

[52] U.S. Cl. ..... 266/275; 75/230

[58] Field of Search ..... 266/275; 75/230

[56] References Cited

U.S. PATENT DOCUMENTS 4,746,363 5/1988 DeAngelis ..... 75/230
4,942,097 7/1990 Santhanam ..... 75/230
5,261,944 11/1993 Lockhart ..... 75/230

OTHER PUBLICATIONS

J. Katz, et al. "The Chemistry of the Actinide Elements", vol. 1 pp. 222–227, Chapman & Hall (1986)
Advertisement by Nippon Time Industries.

*Primary Examiner*—Peter D. Rosenberg
*Attorney, Agent, or Firm*—Emily C. Green; Stephen D. Hamel; William R. Moser

[57] ABSTRACT

A cermet crucible for metallurgically processing metals having high melting points comprising a body consisting essentially of a mixture of calcium oxide and erbium metal, the mixture comprising calcium oxide in a range between about 50 and 90% by weight and erbium metal in a range between about 10 and 50% by weight.

4 Claims, No Drawings

CERMET CRUCIBLE FOR METALLURGICAL PROCESSING

BACKGROUND OF THE INVENTION

This invention relates generally to crucibles used in metallurgy and more particularly to an improved crucible for metallurgically processing metals having high melting points. The United States Government has rights to this invention pursuant to Contract No. DE-AC05-84OR21400 with Martin Marietta Energy Systems, Inc., awarded by the U.S. Department of Energy.

In the reprocessing of certain metals having high melting points, such as scrap and waste uranium metal which has oxidized during storage, a number of methods are used. Each of these methods employs a refractory crucible and high heating rates are desirable. In one method known as "bomb reduction" in which uranium oxide is reprocessed into high-purity uranium metal, uranium oxide is first converted to uranium fluoride and then reduced by calcium or magnesium in a discardable containment system such as a magnesium oxide crucible or tamped magnesium fluoride or calcium fluoride. The crucible in this process is destroyed during the reduction step, and the crucible and slag, in addition to any granular sand used to back-up the crucible, must either be buried as radionuclear waste or processed through a chemical recovery operation to recover the uranium metal. New environmental regulations, however, have eliminated the burial option and the chemical recovery processing is difficult and expensive due to the need to recycle the crucible material through processing after each bomb reduction.

In the saltless direct oxide reduction (SDOR) of uranium oxide, the uranium oxide and a reducing agent at a slight excess are combined and heated to a temperature of about 1100° C. in a crucible consisting of aluminum oxide, magnesium oxide, or calcium oxide. The oxide and any excess reducing agent is then dissolved, and the aqueous phase is separated from the solid uranium metal. The crucibles used in the SDOR process, however, have low thermal conductivity and thus are susceptible to destruction from thermal shock during the heating cycle. This limited durability in turn, increases furnace time and raises the costs of the reprocessing of the additional waste. The magnesia and alumina crucibles, in particular, are not easily dissolved and thus are not recyclable if crucible breakage occurs.

Accordingly, a need in the art exists for an improved crucible that is recyclable and has high thermal conductivity.

SUMMARY OF THE INVENTION

In view of the above need, it is an object of this invention to provide an improved crucible for metallurgically processing metals having high melting points.

Another object of this invention is to provide a crucible as in the above object that is recyclable.

Further, it is an object of this invention to provide a crucible as in the above objects that has high thermal conductivity.

Briefly, the present invention is a cermet crucible for metallurgically processing metals having high melting points comprising a body consisting essentially of a mixture of calcium oxide and erbium metal, the mixture comprising calcium oxide in a range between about 50 and 90% by weight and erbium metal in a range between about 10 and 50% by weight.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION

A cermet crucible according to the present invention is made by homogeneously blending calcium oxide powder in a range between about 50 and 90% by weight with erbium metal powder in a range between about 10 and 50% by weight. The calcium oxide powder is heated prior to blending to a temperature sufficient to remove any calcium hydroxide. A stainless steel cylindrical mandrel having an oversized base is inserted into an elastomer bag so that the oversized base fits into the bottom of the bag, thereby forming an annular mold region to receive the powder. Using an ultra-dry, carbon dioxide-free glove box, the blended powder is poured into the annular mold region of the bag containing the mandrel. The mandrel has an outer dimension corresponding to the inner dimension of the crucible being made, and the blended powder is loaded over the end of the mandrel to form the bottom of the crucible. After the loaded powder is vibrated to achieve maximum density, any air present in the bag is evacuated from the bag by means of vacuum pumping of the bag. The assembly is then placed in an isostatic press and pressed at 15 tons of pressure for about five minutes. Following pressing, the assembly is returned to the glove box where the crucible is unloaded, dressed with a file, and readied for firing.

The cermet crucible of the present invention has several advantages. Because the cermet crucible can be heated to the near melting point of erbium metal (1529° C.), it can be utilized in the SDOR process in which uranium oxide reduction takes place at about 1000° C. In addition as shown in Table I, a direct comparison with a crucible comprising 100% by weight of calcium oxide shows that the present invention comprising calcium oxide in a range between about 50 and 75% by weight and erbium metal in a range between about 25 and 50% by weight withstands a three-fold higher heating rate without breakage from thermal shock. While the calcium oxide crucible endures a heating rate of up to about 10° C./minute, the cermet crucible can withstand up to about 30° C./minute. The increased heating rate of the present invention is believed to be attributable to the thermal conductivities of the component materials in these ranges. Calcium oxide has a low thermal conductivity and behaves like an insulator. By adding erbium metal to the mixture, the thermal conductivity is increased, thus creating a more robust crucible capable of withstanding thermal shock from an exothermic reaction or a when a higher heating rate is desired. This increased resistance to thermal shock in turn, increases the efficiency of the uranium metal reprocessing operation because furnace time is minimized.

The cermet crucible of the present invention also saves costs in the area of waste reprocessing because the crucible is reusable. In the event of crucible breakage, the crucible can be placed in a secondary container in a humid environment and allowed to react until a free flowing powder is obtained. The resulting mixture of calcium hydroxide and erbium metal can be combined with water to form a slurry. Erbium metal is then recovered by conventional filtration techniques for reuse in subsequent crucible manufacture.

Lastly, the size and shape of the present invention can be readily changed to produce specialty shapes by using different size mandrels and bags.

EXAMPLE

A 3.75 inch deep cermet crucible having a two inch inside diameter comprising about 75% by weight calcium oxide and 25% by weight erbium metal was made by blending 168.75g of calcium oxide powder, previously heated to >580° C. to remove any calcium hydroxide, with 56.25 g of erbium metal powder in a sample vessel. The average particle size of the calcium oxide powder was about 150 microns and the average particle size of the erbium metal powder was about 300 microns. Using a glove box, the blended powder was loaded as described above into a cylindrical polyvinyl chloride bag containing a 3.75 inch high stainless steel mandrel having a two inch diameter. The loaded powder was mechanically vibrated to achieve maximum density. Following densification, a 0.25 inch thick stainless steel disc with a center-drilled hole was placed inside the bag on top of the powder. A piston equipped with a 0.25 inch evacuation tube centrally located to align with the disc opening was inserted into the bag. The assembly was sealed by placing a band clamp between the outer bag and piston, and the assembly was vacuum pumped to evacuate any air present inside the assembly. The assembly was then placed in an isostatic press and pressed at 15 tons of pressure for five minutes. After the assembly was returned to the glove box, the crucible was unloaded and filed by hand. The formed crucible was fired in a furnace heated to 1100° C. at a rate of 5° C./minute and held for one hour after which time the furnace power was deactivated and the crucible was cooled to room temperature.

The fabricated cermet crucible was tested in the SDOR process as follows: 100.0 grams of uranium oxide and 34.0 grams of calcium metal were combined and loaded in the crucible. The loaded crucible was heated at a rate of 30° C./minute to 1100° C. and held for one hour. At the end of one hour, the furnace power was deactivated and the crucible was cooled to room temperature. The cooled crucible was emptied of its contents and visually inspected for damage from thermal shock.

Table I shows other cermet crucibles with varying weight percentages of erbium metal and calcium oxide fabricated and tested as described above. The heating rates shown in Table I represent the maximum rates which the tested crucibles could endure before they were damaged by thermal shock.

TABLE I

| Example | Weight Percent Erbium | Weight Percent Calcium Oxide | Heating Rate °C./minute |
|---|---|---|---|
| 1 | 0 | 100 | 10 |
| 2 | 10 | 90 | 16 |
| 3 | 25 | 75 | 30 |
| 4 | 50 | 50 | 30 |

Although it will be seen that an improved crucible for use in metallurgically processing uranium has been provided, it will be obvious to one skilled in the art that the cermet crucible may be useful in several different applications. In addition to reprocessing uranium oxide and uranium metal, the cermet crucible is well-suited for the casting of uranium metal for use in component parts. Plutonium and other metals and alloys with high melting points may be processed using the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A crucible for use in metallurgically processing metals having high melting points comprising a body consisting essentially of a mixture of calcium oxide and erbium metal.

2. A crucible as in claim 1 wherein said calcium oxide is in a range between about 50 and 90 weight percent of said mixture.

3. A crucible as in claim 2 wherein said erbium metal is in a range between about 10 and 50 weight percent of said mixture.

4. A crucible as in claim 1 wherein said body is formed by isostatic pressing of said mixture.

* * * * *